United States Patent [19]

Kälin

[11] Patent Number: 4,995,563

[45] Date of Patent: Feb. 26, 1991

[54] APPARATUS FOR WINDING UP AND UNWINDING PRINTED PRODUCTS INFED AND OUTFED IN AN IMBRICATED FORMATION BY MEANS OF A CONVEYOR

[75] Inventor: Urs Kälin, Hinwil, Switzerland

[73] Assignee: Ferag AG, Hinwil, Switzerland

[21] Appl. No.: 440,409

[22] Filed: Nov. 17, 1989

Related U.S. Application Data

[63] Continuation of Ser. No. 215,049, Jul. 5, 1988, abandoned.

[30] Foreign Application Priority Data

Jul. 2, 1987 [CH] Switzerland ..... 2524/87

[51] Int. Cl.[5] ..... B65H 63/08; B65H 61/00

[52] U.S. Cl. ..... 242/59; 242/57; 242/75.450

[58] Field of Search ..... 242/57, 59, 75.45, 75.47, 242/75.51

[56] References Cited

U.S. PATENT DOCUMENTS

| | | | |
|---|---|---|---|
| 4,438,618 | 3/1984 | Honegger | 242/59 |
| 4,532,750 | 8/1985 | Meier | 242/59 X |
| 4,550,883 | 11/1985 | Boss | 242/59 |
| 4,587,790 | 5/1986 | Muller | 242/59 X |
| 4,589,603 | 5/1986 | Muller | 242/59 |
| 4,651,941 | 3/1987 | Müller | 242/59 |
| 4,703,901 | 11/1987 | Stauber | 242/59 |

*Primary Examiner*—Daniel P. Stodola

*Assistant Examiner*—John P. Darling

*Attorney, Agent, or Firm*—Willian Brinks Olds Hofer Gilson & Lione

[57] ABSTRACT

One end of a winding band is secured to a winding core. The winding band travels from a supply spool over a deflection roll rotating at a circumferential velocity corresponding to the conveying velocity of the product conveyor delivering the printed products. The winding core is driven during winding up of a product package formed of printed products and during the unwinding of the product package the winding core is braked whereas during such operations the supply spool is respectively braked or driven, as the case may be. To simplify the drive concept and to ensure for a faultless operation of the winding apparatus, both during winding up and during unwinding of the printed products, the winding core is operatively coupled with an electrical regulation motor and the core of the supply spool is operatively coupled with a rotating electrical machine, and in both rotational directions there is tapped off for the rotational speed of the electrical regulation motor the reference or set value from the product conveyor essentially corresponding to the conveyor velocity and the actual value from the deflection roll essentially corresponding to its circumferential velocity, whereas the rotary electrical machine coupled with the core of the supply spool is operated in one rotational direction with braking slip and in the other rotational direction with drive slip.

9 Claims, 3 Drawing Sheets

APPARATUS FOR WINDING UP AND UNWINDING PRINTED PRODUCTS INFED AND OUTFED IN AN IMBRICATED FORMATION BY MEANS OF A CONVEYOR

This application is a continuation of application Ser. No. 07/215,049filed July 5, 1988, now abandoned.

CROSS-REFERENCE TO RELATED APPLICATION

This application is related to the commonly assigned, co-pending U.S. Application Ser. No. 07/163,346, filed Mar. 2, 1988, entitled APPARATUS FOR THE CONTINUOUS WINDING-UP OR WINDING-OFF OF SUBSTANTIALLY FLAT STRUCTURES INTO A PACKAGE AND FROM A PACKAGE, RESPECTIVELY. The disclosure of this application is incorporated herein by reference.

BACKGROUND OF THE INVENTION

The present invention relates to a new and improved construction of apparatus for, broadly stated, winding, and more particularly, selectively winding up and unwinding substantially flat products or structures or articles, particularly printed products, which are infed and outfed in the form of an imbricated or shingled stream of products by means of a conveyor.

During winding up of the infed imbricated product formation such is wound so as to form a product package or wound package and alternatively during the product unwinding operation the printed products are unwound from a product package.

Generally speaking, the winding apparatus of the present development for winding up and unwinding printed products, especially newspapers, magazines, periodicals or the like, infed and outfed, as the case may be, in the form of an imbricated or shingled product stream by means of a conveyor or conveyor device, so as to form, when winding the products, a product package, and unwinding the products from a product package during the unwinding operation, comprises a winding core or core member with which there is connected one end of a winding band or strap, also referred to sometimes in the art as a winding-tape. This winding band or strap extends from a supply spool or spool member over a deflection roll to the winding core or from the product package wound thereon. The deflection roll or roll member rotates at its circumference at the conveying velocity or speed of the conveyor. The winding core is driven or braked, as the case may be, and at the same time the supply spool is braked or driven, as the case may be.

Such type of winding apparatus is disclosed in the German Pat. Publication No. 3,123,888, and the cognate U.S. Pat. No. 4,438,618, granted Mar. 27, 1984. An essential element of this state of the art winding apparatus is constituted by the deflection roll over which travels the winding band from the supply spool to the package or vice versa. With the heretofore known winding apparatus, this deflection roll is positively driven such that its circumferential velocity is equal to the conveying velocity of the imbricated stream of products This deflection roll, both during the winding up of the products as well as also during the unwinding of the products, governs the circumferential velocity of the product package and accordingly its rotational speed. With the heretofore known winding apparatus the winding core is driven by means of a winding gearing unit or transmission during the winding up operation. This winding gearing unit or transmission has the tendency of driving the winding core such that the circumferential velocity of the product package leads the conveying velocity of the imbricated stream of products. As a result, there is realized the effect that the winding band is exposed to a tensile or tensional load, even if such only causes a slight elongation of the winding band, between the deflection roll and the run-on location or point of contact with the product package or wound package and such winding band is wound up thereupon in such tensioned condition.

In order to circumvent the need for using a winding gearing unit or transmission as employed in the previously mentioned known construction of winding apparatus, it has been proposed to employ a further comparable winding apparatus in German Pat. Publication No. 3,345,191, and the cognate U.S. Pat. No. 4,651,941. In this case the winding core is driven by an electrical regulation motor, the rotational speed of which is computed from the infeed velocity of the imbricated product stream and the instantaneous package diameter. With this further known construction of winding apparatus the winding band is advanced, while experiencing a braking action, such that its velocity is continuously accommodated to the infeed velocity without the tension in the winding band altering during the acceleration or deceleration phases.

SUMMARY OF THE INVENTION

Therefore, with the foregoing in mind it is a primary object of the present invention to provide a new and improved construction of winding apparatus of the previously mentioned type, wherein a length of the winding band or strap is wound up or unwound, as the case may be, corresponding to the length of the wound up or unwound imbricated formation of products, and this winding band length is not determined in accordance with a (computed) reference rotational speed of the product package, rather conversely the product package is driven at such a rotational speed that the actual consumption of winding band is achieved independent of the constriction or indentation at the circumference of the product package and which is produced by the tension of the winding band.

Another significant object of the present invention is directed to a new and improved construction of winding apparatus wherein the product package can be wound with a winding strap or band in an extremely reliable and product-protective manner.

Now in order to implement these and still further objects of the invention, which will become more readily apparent as the description proceeds, the winding apparatus of the present development is manifested, among other things, by the features that, the winding core or core member is operatively coupled or connected with an electrical regulation or regulating motor and the core or core member of the supply spool is operatively coupled or connected with a rotary electrical machine. In both rotational directions, there is tapped off for the rotational speed of the regulation or regulating motor the reference or set value from the conveyor essentially corresponding to the conveyor velocity and the actual value from the deflection roll essentially corresponding to the circumferential velocity or speed thereof, and to the velocity of the winding band, whereas the rotary electrical machine which is coupled at the supply spool is operated in one direction with braking slip and in the other direction with drive slip.

By virtue of this design the proposed winding apparatus of the present development, starting from the type of winding apparatus disclosed in the aforementioned German Pat. Publication No. 3,123,888 and the cognate U.S. Pat. No. 4,438,618, is diametrically opposite in its principle of operation in comparison to the winding apparatus disclosed in the likewise aforementioned German Pat. Publication No. 3,345,191, and the cognate U.S. Pat. No. 4,651,941.

Additionally, with the proposed winding apparatus of the present development it is worthy of mention that the circumferential velocity or speed of the product package—measured at the winding band or strap—exactly corresponds to the conveying or feed velocity of the imbricated stream of printed products, since the winding band or strap in its entirety is elongated between the supply spool and the product package, in other words, travels onto the deflection roll or roller in an elongated condition or state. On the other hand, since, and in particular, during winding up of the printed products the actual "band consumption" constitutes the actual value and by means of the rotational speed of the regulation motor there is strived for a reference or set consumption of winding band or strap, there is realized a compensation of the constriction or indentation of the product package or wound package caused by the winding band or strap, by virtue of a corresponding increase in the drive rotational speed of the winding core or mandrel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
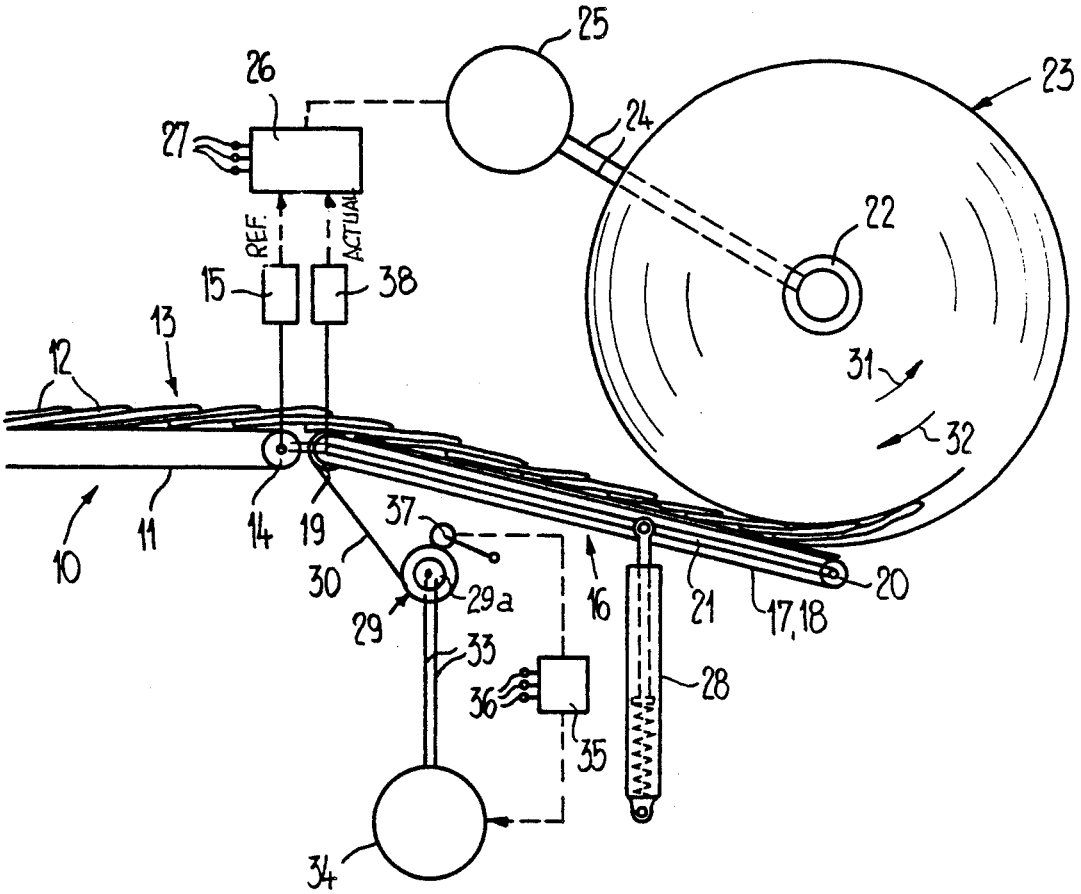
FIG. 1 is a schematic illustration in side view of a first exemplary embodiment of winding apparatus constructed according to the present invention.

Describing now the drawings, it is to be understood that to simplify the showing thereof, only enough of the construction of the winding apparatus, particularly for the winding up and unwinding of flat or superficial structures, product or articles especially printed products, such as newspapers, magazines, periodicals or the like, has been illustrated therein as is needed to enable one skilled in the art to readily understand the underlying principles and concepts of this invention. Turning now specifically to FIG. 1 of the drawings, it will be recognized that for the winding apparatus depicted in FIG. 1, there is shown an end section or portion or a starting section or portion, depending upon the current manner of operation of the winding apparatus i.e. for winding-up or unwinding of the products, of a conveyor or conveyor device 10 comprising a conveyor band or belt 11. This conveyor or conveyor device 10 conveys printed products 12, such as newspapers, magazines, periodicals or the like in an imbricated or shingled stream 13 of such printed products 12. The conveyor band 11 trains about a deflection roll or roller 14, the rotational speed and direction of rotation of which is detected by a schematically illustrated transmitter 15, for instance a tachogenerator.

Merging with the conveyor or conveyor device 10 is, again depending or the current manner of operation of the winding apparatus, an infeed or outfeed conveyor or conveyor device 16 which, for instance, is formed as a band or belt conveyor structure having two conveyor bands or belts 17 and 18 which travel adjacent one another in laterally spaced relationship. The conveyor bands or belts 17 and 18 train about deflection rolls or rollers 19 and 20 which are rotatably mounted at the ends of a frame or frame member 21. This frame or frame member 21, in turn, is arranged to be pivotable or swivelable about the axis of rotation of the deflection roll or roller 19. As will be further demonstrated hereinafter, this "deflection roll or roller 19" comprises a set of three coaxially arranged deflection rolls of the same diameter, wherein both of the outer two rolls are operatively associated with the conveyor bands or belts 17 and 18.

There will be further recognized from the illustration of FIG. 1 that there is provided a winding core or mandrel 22 which is rotatably mounted in not particularly illustrated but conventional stationary supports or bearings. The printed products 12 are wound in the form of a product package or wound package 23 onto the winding core or mandrel 22. As has been indicated by the lines 24 the winding core or mandrel 22 is directly connected with a regulation or regulating motor 25. This regulation motor or means 25, which also can be a gearing motor having a fixed transmission ratio, can be constituted by a reversible, frequency-controlled asynchronous machine or a reversible direct-current machine, and in any event advantageously is a reversible electric motor whose rotational speed can be infinitely regulated. The regulation motor 25 has arranged at the input side, in other words forwardly or upstream thereof in the depicted illustration of FIG. 1, a power supply circuit 26 which can be connected via the terminals 27 with the power supply network and which imparts to the energy which is drawn from the power supply network the parameters which govern the rotational speed of the regulation motor 25, for instance voltage, frequency, and possibly rectification of the power supply.

Reverting further to FIG. 1, it will be recognized that the frame or frame member 21 and thus the conveyor or conveyor device 16 is exposed to the action of a resilient or spring element or unit 28 which strives to force the conveying-active run or side of the conveyor or conveyor device 16 against the circumference or outer surface of the product package 23.

Beneath the conveyor or conveyor device 16 there is arranged a supply spool or spool member 29 for a winding band or strap 30 or equivalent structure. It is to be understood that the term "supply spool" is used broadly for both the product winding and unwinding operations. The winding band 30 trains about the intermediate one of the deflection rolls 19 between the conveyor bands or belts 17 and 18 and from that location travels onto the product package 23. The not particularly referenced starting portion of the winding band 30 is appropriately secured to the winding core or mandrel 22. During winding up of the printed products 12 to form the product package or wound package 23, in the direction of the arrow 31 depicted in FIG. 1, the winding band or strap 30 is wound up in conjunction with the printed products 12 of the imbricated stream 13 and, conversely, during unwinding of the printed products 12, this time in the direction of the arrow 32 of FIG. 1, the winding band or strap 30 is released in order to again arrive by means of the associated deflection roll 19 at the supply spool or spool member 29.

As indicated by the lines 33 the core or core member **29*a* of the supply spool 29 is directly coupled with a rotary electrical machine 34. This rotary electrical machine 34 can be advantageously constituted by a reversible direct-current machine which can be switched to operate either as a generator or as a motor. This rotary electrical machine or direct-current machine 34 is powered by a rectifying power supply circuit 35 which can be connected by the terminals 36 with the power supply network and which during winding up of the product package 23, in the direction of the arrow 31 of FIG. 1, switches the rotary electrical machine 34 to operate as a generator. The brake moment or torque exerted during such time by the rotary electrical machine 34 upon the supply spool 29 is regulated as a function of the momentary or instantaneous diameter of the supply spool 29 which, in turn, is scanned by a transmitter 37 which is connected to the power supply circuit 35. It also will be observed that a further transmitter 38, for instance a tachogenerator, is operatively coupled with the deflection roll or roller 19 of the winding band or strap 30. This transmitter or transmitter member 38 delivers to the power supply circuit 26, a signal which is characteristic for a predeterminate parameter or parameters of the deflection roll 19, here, the direction of rotation and the rotational speed and thus circumferential velocity of the deflection roll 19**.

Having now had the benefit of the description of the heretofore considered exemplary embodiment of winding apparatus, the mode of operation thereof will be considered and is as follows:

The circumferential velocity or speed of the product package 23 is transmitted by means of the winding band or strap 30 to the associated deflection roll or roller 19 which is freely rotatable. This deflection roll 19, in turn, delivers by means of the transmitter or transmitter member 38 an actual value, as previously explained, to the power supply circuit 26. On the other hand, this power supply circuit 26 receives by means of the transmitter or transmitter member 15 a signal constituting a reference or set value and which is characteristic for the conveying velocity of the conveyor or conveyor device 10. The power supply circuit 26 then regulates the rotational speed of the regulation or regulating motor 25 in such a manner that the circumferential velocity of the product package or wound package 23 at the run-on location or, as the case may be, the run-off location of the winding band or strap 30 corresponds to the conveying velocity of the product conveyor or conveYor device 10. At the run-on or run-off location of the winding band or strap 30 the product package 23 is constricted, particularly when it possesses a larger diameter. In other words, what is regulated is the velocity of the winding band or strap 30 in accordance with the conveying velocity of the conveyor or conveyor device 10 as the reference or set magnitude or value. The same also holds true in comparable fashion for the product winding up operation as well as for the unwinding of the product package 23.

On the other hand, the rotary electrical machine 34, during winding up of the product package 23 in the aforedescribed manner, operates with braking or brake slip, whereas the rotary electrical machine 34 during unwinding of the product package 23, in the direction of the arrow 32 of FIG. 1, is switched to operate as a motor and operates with drive or driving slip.

Figure 2:
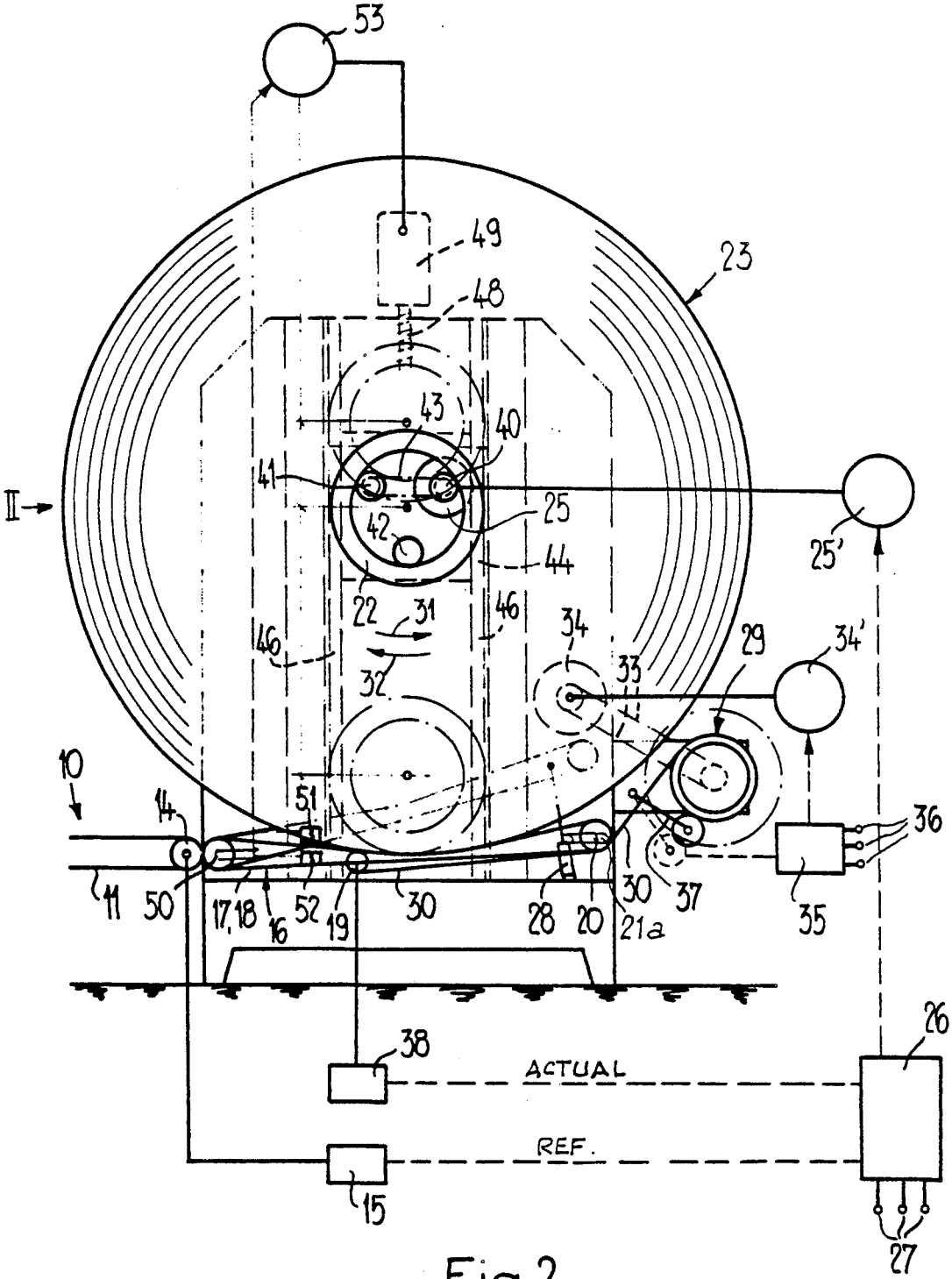
FIG. 2 is a schematic illustration, again in side view, of a second exemplary embodiment of winding apparatus according to the present invention, wherein the electrical circuit diagram has been conveniently depicted therein in positionally shifted and overlayed configuration to facilitate the showing of the drawings and comprehensibility thereof.
Figure 3:
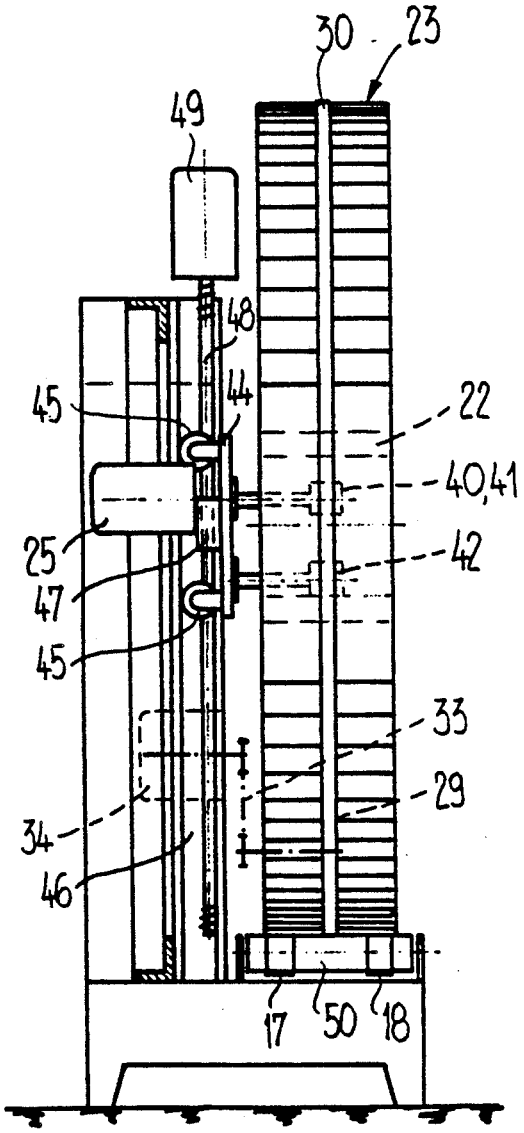
FIG. 3 is a simplified end view of the winding apparatus depicted in FIG. 2, viewed in the direction of the arrow II thereof.

Turning attention now to the embodiment depicted in FIGS. 2 and 3, it is to be firstly understood that there have been generally conveniently utilized the same reference characters for parts or components corresponding in function to the embodiment of winding apparatus depicted and described previously with reference to FIG. 1, wherein, however, with the circuit diagram depicted in FIG. 2 in superimposed and positionally shifted orientation, such reference characters have additionally applied thereto a prime (') marking. The hollow winding core or mandrel 22 shown in FIGS. 2 and 3 is, in this case, supported upon three support or carrier rolls or rollers 40, 41 and 42. It will be observed that the one support or carrier roll or roller 40 is directly coupled with the regulation or regulating motor 25' and also drives the other or second support or carrier roll or roller 41 by means of a chain drive 43. The final or third support roll 42 is freely rotatable and only serves to retain the winding core or mandrel 22 in snug contact with the other two driving support rolls or rollers 40 and 41.

These three support rolls or rollers 40, 41 and 42 protrude laterally from a carriage or slide member 44, to which there is flanged or otherwise appropriately connected at the other or opposite side the regulation or regulating motor 25'. This carriage or slide member 44 is displaceably guided by means of the guide rolls or rollers 45 at two upright or substantially vertically extending guide rails or rail members 46 or equivalent structure. The carriage or slide member 44 is provided with a nut member 47 or equivalent structure into which there is threaded an axial non-displaceable threaded spindle or spindle member 48. This threaded spindle 48 is coupled with a reversible motor 49, to which reference will be again made shortly hereinafter.

Both of the conveyor bands or belts 17 and 18 which merge with the conveyor band or belt 11, train about the deflection roll or roller 20 and a deflection roll or roller 50. The winding band or strap 30 which emanates or originates from the supply spool 29 is guided from below about the deflection roll 20 and solely trains about the deflection roll 19 which is located between the conveyor bands or belts 17 and 18. These conveyor bands or belts 17 and 18 are comparatively slack, so that they train or wrap about a portion of the circumference of the product package 23 owing to the contact force which is exerted by the resilient or spring element 28. Consequently, the conveyor bands or belts 17 and 18 are driven by the circumferential region or outer surface of the product package 23 and place into rotation the deflection rolls or rollers 20 and 50 which are freely rotatably mounted in the not here extensively illustrated frame, which is, for instance, like the frame or frame member 21 of the embodiment of FIG. 1, and thus merely generally indicated by reference character 21*a*. On the other hand, the deflection roll 19 is driven by the winding band or strap 30 and thus has the same circumferential velocity as the product package 23 at the run-on location or run-off location, as the case may be, of the winding band or strap 30.

Two sensors or sensor members 51 and 52, for instance in the form of light barriers or proximity switches, scan the momentary position of the pivotable or swivelable frame 21*a* which supports the deflection rolls or rollers 19, 20 and 50. The momentary position of this frame 21*a* is dependent upon the position or location of the lowest point of the product package 23. The sensors 51 and 52 are connected with an ON-OFF and switching device 53 which, in turn, controls the reversible motor 49. By virtue of this operation there is thus accommodated the elevational position of the carriage or slide member 44 and in conjunction therewith that of the winding core 22 to the momentary or current diameter of the product package or wound package 23, so that the conveyor bands or belts 17 and 18 always train or wrap about the lowermost portion of the circumference of the product package 23. The motor 49 also can be turned-on and turned-off, as the case may be, by means of a manually operable switch in order to adjust or regulate the elevational position of the carriage or slide member 44 such that the winding core 22 together with the product package 23 can be removed from the support rolls 40, 41 and 42 or so that a new empty winding core 22 can be placed upon such support rolls 40, 41 and 42.

Although the exemplary embodiment depicted in FIGS. 2 and 3 differs in its external construction appreciably from the exemplary embodiment of FIG. 1, the drive concept and the mode of operation is exactly the same as previously considered in conjunction with the embodiment of FIG. 1.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for winding, especially selectively winding up into a product package and unwinding from a product package printed products, particularly newspapers, magazines and periodicals, in the form of an imbricated stream of such printed products, comprising:

a winding core for the printed products;

conveyor means having a predeterminate conveyor velocity for transporting the printed products to and from the winding core;

a spool for a winding band and having a diameter depending upon the amount of wound-up winding band located thereon;

said winding band being connected at one end with the winding core;

a rotatable deflection roll operatively associated with said supply spool;

said winding band extending between the spool and the winding core and passing over the rotatable deflection roll;

the winding core being driven or braked and at the same time the spool being braked or driven, respectively;

an electrical regulation motor operatively connected with the winding core;

said spool having a core;

a rotary electrical machine operatively connected with the core of the spool;

said winding core being bi-directionally rotatable;

means for tapping off a reference value of the conveyor means, essentially corresponding to the predeterminate conveyor velocity of the conveyor means, in both directions of rotation of the winding core for controlling the rotational speed of the electrical regulation motor;

means for tapping off an actual value of the circumferential speed of the deflection roll in both directions of rotation of the winding core;

means for generating a signal indicative of the momentary diameter of said spool;

control means connected in circuit between said means for generating said signal indicative of the momentary diameter of said spool and said rotary electrical machine for controlling the torque exerted by said rotary electrical machine and operating said rotary electrical machine in one rotational direction with braking slip and in the other rotational direction with drive slip.

2. The winding apparatus as defined in claim 1, wherein:

said electrical regulation motor comprises a reversible frequency-controlled asynchronous machine;

said reversible frequency-controlled asynchronous machine having an input side;

a power supply circuit connected with the input side of said reversible frequency-controlled asynchronous machine;

a transmitter operatively connected with the conveyor means for transmitting a signal representative of the predeterminate conveyor velocity of said conveyor means;

a transmitter operatively connected with the rotatable deflection roll for transmitting a signal indicative of the circumferential speed of said rotatable deflection roll under the action of said winding band passed over said rotatable deflection roll; and said power supply circuit being coupled with the transmitter operatively coupled with the conveyor means and with the transmitter operatively coupled with the deflection roll.

3. The winding apparatus as defined in claim 1, wherein:

said electrical regulation motor comprises a reversible direct-current machine having an input side;

a power supply circuit connected with the input side of said reversible direct-current machine;

a first transmitter operatively coupled with said conveyor means for transmitting a signal representative of the predeterminate conveyor velocity of said conveyor means;

a second transmitter operatively coupled with said rotatable deflection roll for transmitting a signal indicative of the circumferential speed of said rotatable deflection roll under the action of said winding band passed over said rotatable deflection roll; and said power supply circuit being operatively coupled with said first transmitter and with said second transmitter.

4. The winding apparatus as defined in claim 1, wherein:

said rotary electrical machine which is coupled with said spool comprises a direct-current servo machine which can be switched to operate selectively as a motor and as a generator; and said direct-current servo machine at least in the generator mode of operation being torque-controlled as a function of the momentary diameter of the spool.

5. The winding apparatus as defined in claim 1, wherein:

said deflection roll comprises a freely rotatably mounted roll which can be placed into rotation by the winding band;

two freely revolvingly arranged band members;

said deflection roll being arranged between said two freely revolvingly arranged band members; and said two freely revolvingly arranged band members training about a lowermost portion of the winding core or the product package which is located upon the winding core and being entrained by the winding and unwinding rotations of said winding core and said product package.

6. The winding apparatus as defined in claim 5, further including:

deflection rolls over which travel the two freely revolvingly arranged band members;

frame means in which there are mounted said deflection rolls over which there are trained said band members; and resilient force applying means acting upon said frame means for forcing said frame means against the outer circumference of the winding core or a wound package located thereupon.

7. The winding apparatus as defined in claim 6, further including:

mounting means for mounting the winding core;

said winding core carrying a product package having a size which varies as a function of the state of completion of either one of (i) the winding-up operation or (ii) the unwinding operation;

means for displaceably guiding in essentially upright direction said mounting means for said winding core;

elevational drive means with which there is operatively coupled said mounting means; and means for switching on and switching off said elevational drive means in selective first and second mutually opposite directions in dependence upon the momentary size of said product package carried by said winding core.

8. An apparatus for winding, especially selectively winding up into a product package and unwinding from a product package printed products, particularly newspapers, magazines and periodicals, in the form of an imbricated stream of such printed products, comprising:

a winding core for the printed products;

conveyor means for transporting the printed products to and from the winding core;

a spool for a winding band and having a diameter depending upon the amount of wound-up winding band located thereon;

said winding band being connected at one end with the winding core;

a rotatable deflection roll operatively associated with said spool;

said winding band extending between the spool and the winding core and passing over the rotatable deflection roll;

the winding core being driven or braked and during such time the spool being braked or driven, respectively;

an electrical regulation motor operatively connected with the winding core;

said spool having a core;

a rotary electrical machine operatively connected with the core of the spool;

said winding core being bi-directionally rotatable;

means for tapping off a reference value of the conveyor means essentially corresponding to a predeterminate parameter of the conveyor means, in both directions of rotation of the winding core for controlling the rotational speed of the electrical regulation motor;

means for tapping off an actual value corresponding to a predeterminate parameter of the deflection roll in both directions of rotation of the winding core;

means for generating a signal indicative of the momentary diameter of said spool;

control means connected in circuit between said means for generating said signal indicative of the momentary diameter of said spool and said rotary electrical machine for controlling the torque exerted by said rotary electrical machine and operating said rotary electrical machine in one rotational direction with braking slip and in the other rotational direction with drive slip.

9. An apparatus for winding, especially selectively winding up into a produce package and unwinding from a product package printed products, particularly newspapers, magazines and periodicals in the form of an imbricated stream of such products, comprising:

a winding core for the printed products;

conveyor means having a conveying velocity for conveying the printed products to and from the winding core;

a spool for a winding band;

said winding band being connected at one end with the winding core;

a freely rotatable deflection roll;

said winding band extending between the spool and the winding core and passing over the freely rotatable deflection roll;

al electrical regulation motor operatively connected with the winding core for driving said winding core in winding and in unwinding direction;

means for tapping off a reference value of the conveyor means corresponding to the conveying velocity of the conveyor means in both directions of rotation of the winding core;

means for tapping off an actual value of the circumferential speed of the freely rotatable deflection roll in both directions of rotation of the winding core;

both said tapping off means being connected to a control means for controlling the rotational speed of the regulation motor such that the speed with which the winding band is wound and unwound, respectively corresponds to said conveying velocity;

said spool having a core operatively connected to a drive means;

said drive means being controlled such that in the winding direction of the winding core it operates with brake slip and in the unwinding direction of the winding core it operates with drive slip in order to maintain the tension of the winding band substantially constant.

* * * * *